US009382769B2

(12) United States Patent
Wilson et al.

(10) Patent No.: US 9,382,769 B2
(45) Date of Patent: Jul. 5, 2016

(54) TELEMETRY OPERATED CIRCULATION SUB

(75) Inventors: Timothy L. Wilson, Houston, TX (US); Albert C. Odell, Kingwood, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 289 days.

(21) Appl. No.: 13/979,360

(22) PCT Filed: Jan. 23, 2012

(86) PCT No.: PCT/US2012/022253

§ 371 (c)(1),
(2), (4) Date: Aug. 20, 2013

(87) PCT Pub. No.: WO2012/100259

PCT Pub. Date: Jul. 26, 2012

(65) Prior Publication Data

US 2013/0319767 A1 Dec. 5, 2013

Related U.S. Application Data

(60) Provisional application No. 61/435,218, filed on Jan. 21, 2011.

(51) Int. Cl.
*E21B 21/10* (2006.01)
*E21B 47/12* (2012.01)
(Continued)

(52) U.S. Cl.
CPC ..... *E21B 21/103* (2013.01); *E21B 21/10* (2013.01); *E21B 47/124* (2013.01); *E21B 47/18* (2013.01); *E21B 2034/007* (2013.01)

(58) Field of Classification Search
USPC ..... 175/24, 65, 232
See application file for complete search history.

(56) References Cited

U.S. PATENT DOCUMENTS 4,113,012 A 9/1978 Evans et al.
4,298,077 A 11/1981 Emery
(Continued)

FOREIGN PATENT DOCUMENTS

GB 2268770 A 1/1994
GB 2394488 A 4/2004
(Continued)

OTHER PUBLICATIONS

International Search Report and Written Opinion for Application No. PCT/US2012/022253 Dated Apr. 25, 2013.
(Continued)

*Primary Examiner* — Taras P Bemko
(74) *Attorney, Agent, or Firm* — Patterson & Sheridan, LLP

(57) ABSTRACT

A method of drilling a wellbore includes drilling the wellbore by injecting drilling fluid through a drill string extending into the wellbore from surface and rotating a drill bit of the drill string. The drill string further includes a circulation sub having a port closed during drilling. The drilling fluid exits the drill bit and carries cuttings from the drill bit. The drilling fluid and cuttings (returns) flow to the surface via an annulus formed between an outer surface of the tubular string and an inner surface of the wellbore. The method further includes after drilling at least a portion of the wellbore: halting drilling; sending a wireless instruction signal from the surface to a downhole portion of the drill string by articulating the drill string, acoustic signal, or mud pulse, thereby opening the port; and injecting drilling fluid through the drill string and into the annulus via the open port.

17 Claims, 9 Drawing Sheets

(51) Int. Cl.
*E21B 47/18* (2012.01)
*E21B 34/00* (2006.01)

(56) References Cited

U.S. PATENT DOCUMENTS

| | | | | |
|---|---|---|---|---|
| 4,373,582 | A | 2/1983 | Bednar et al. | |
| 4,406,335 | A | 9/1983 | Koot | |
| 4,557,333 | A * | 12/1985 | Beck | 166/374 |
| 4,574,894 | A | 3/1986 | Jadwin | |
| 4,633,958 | A | 1/1987 | Mouton | |
| 4,657,082 | A | 4/1987 | Ringgenberg | |
| 4,889,199 | A | 12/1989 | Lee | |
| 5,146,992 | A | 9/1992 | Baugh | |
| 5,335,731 | A | 8/1994 | Ringgenberg et al. | |
| 5,443,129 | A | 8/1995 | Bailey et al. | |
| 5,465,787 | A | 11/1995 | Roth | |
| 5,499,687 | A | 3/1996 | Lee | |
| 5,791,414 | A | 8/1998 | Skinner et al. | |
| 5,890,540 | A | 4/1999 | Pia et al. | |
| 5,901,796 | A | 5/1999 | McDonald | |
| 5,979,572 | A | 11/1999 | Boyd et al. | |
| 6,065,541 | A | 5/2000 | Allen | |
| 6,095,249 | A | 8/2000 | McGarian et al. | |
| 6,102,060 | A | 8/2000 | Howlett et al. | |
| 6,152,228 | A | 11/2000 | Carmichael | |
| 6,173,795 | B1 | 1/2001 | McGarian et al. | |
| 6,189,618 | B1 | 2/2001 | Beeman et al. | |
| 6,220,357 | B1 | 4/2001 | Carmichael et al. | |
| 6,253,861 | B1 | 7/2001 | Carmichael et al. | |
| 6,279,657 | B1 | 8/2001 | Carmichael et al. | |
| 6,289,999 | B1 | 9/2001 | Dewey et al. | |
| 6,378,612 | B1 | 4/2002 | Churchill | |
| 6,543,532 | B2 | 4/2003 | Estep et al. | |
| 6,725,937 | B1 | 4/2004 | McHardy | |
| 6,732,793 | B1 | 5/2004 | Lee | |
| 6,820,697 | B1 | 11/2004 | Churchill | |
| 6,866,100 | B2 | 3/2005 | Gudmestad et al. | |
| 6,920,930 | B2 | 7/2005 | Allamon et al. | |
| 7,055,605 | B2 | 6/2006 | Howlett et al. | |
| 7,168,493 | B2 | 1/2007 | Eddison | |
| 7,281,584 | B2 | 10/2007 | McGarian et al. | |
| 7,299,880 | B2 | 11/2007 | Logiudice et al. | |
| 7,318,478 | B2 | 1/2008 | Royer | |
| 7,322,419 | B2 | 1/2008 | Carmichael | |
| 7,337,847 | B2 | 3/2008 | McGarian et al. | |
| 7,347,288 | B2 | 3/2008 | Lee | |
| 7,350,598 | B2 | 4/2008 | Booth | |
| 7,357,198 | B2 | 4/2008 | Mcgarian et al. | |
| 7,383,881 | B2 | 6/2008 | Telfer | |
| 7,416,029 | B2 | 8/2008 | Telfer et al. | |
| 7,441,607 | B2 | 10/2008 | Telfer | |
| 7,503,398 | B2 | 3/2009 | LoGiudice et al. | |
| 7,520,336 | B2 | 4/2009 | Mondelli et al. | |
| 7,530,400 | B2 | 5/2009 | Telfer | |
| 7,628,213 | B2 | 12/2009 | Telfer | |
| 7,661,478 | B2 | 2/2010 | Palmer et al. | |
| 7,673,708 | B2 | 3/2010 | Lee | |
| 7,681,650 | B2 | 3/2010 | Telfer et al. | |
| 7,766,084 | B2 | 8/2010 | Churchill | |
| 7,766,086 | B2 | 8/2010 | Mondelli et al. | |
| 8,540,305 | B2 | 9/2013 | Schulte et al. | |
| 8,794,354 | B2 | 8/2014 | Xu et al. | |
| 2003/0066652 | A1 * | 4/2003 | Stegemeier et al. | 166/373 |
| 2004/0163809 | A1 * | 8/2004 | Mayeu et al. | 166/255.1 |
| 2005/0230119 | A1 * | 10/2005 | McGarian et al. | 166/334.4 |
| 2007/0284111 | A1 | 12/2007 | Ashy et al. | |
| 2007/0285275 | A1 | 12/2007 | Purkis et al. | |
| 2008/0029306 | A1 * | 2/2008 | Krueger et al. | 175/210 |
| 2008/0093080 | A1 | 4/2008 | Palmer et al. | |
| 2008/0190620 | A1 | 8/2008 | Posevina et al. | |
| 2009/0025923 | A1 * | 1/2009 | Patel et al. | 166/51 |
| 2009/0095486 | A1 | 4/2009 | Williamson, Jr. | |
| 2010/0065125 | A1 | 3/2010 | Telfer | |
| 2010/0252276 | A1 | 10/2010 | Clausen et al. | |
| 2010/0270034 | A1 | 10/2010 | Clausen | |
| 2014/0014360 | A1 | 1/2014 | Wilson | |

FOREIGN PATENT DOCUMENTS

| | | | |
|---|---|---|---|
| WO | 02/075104 | A1 | 9/2002 |
| WO | 2008005289 | A2 | 1/2008 |

OTHER PUBLICATIONS

Canadian Office Action dated Dec. 4, 2014, Canadian Patent Application No. 2,824,522.

Australian Patent Examination Report dated Jun. 17, 2015, for Australian Patent Application No. 2012207114.

PCT Notification of Transmittal of the International Search Report and the Written Opinion of the International Searching Authority for International Application No. PCT/US2012/022253 dated Apr. 25, 2013; 13 total pages.

PCT Notification of Transmittal of the International Search Report and the Written Opinion of the International Searching Authority for International Application No. PCT/US2013/049982 dated Jul. 10, 2014; 11 total pages.

* cited by examiner

TELEMETRY OPERATED CIRCULATION SUB

CROSS-REFERENCE TO RELATED APPLICATIONS

This application claims benefit of U.S. provisional patent application Ser. No. 61/435,218, filed Jan. 21, 2011, which is herein incorporated by reference in its entirety.

BACKGROUND OF THE INVENTION

1. Field of the Invention

Embodiments of the present invention generally relate to a telemetry operated circulation sub.

2. Description of the Related Art

A wellbore is formed to access hydrocarbon bearing formations, e.g. crude oil and/or natural gas, by the use of drilling. Drilling is accomplished by utilizing a drill bit that is mounted on the end of a tubular string, such as a drill string. To drill within the wellbore to a predetermined depth, the drill string is often rotated by a top drive or rotary table on a surface platform or rig, and/or by a downhole motor mounted towards the lower end of the drill string. After drilling to a predetermined depth, the drill string and drill bit are removed and a section of casing is lowered into the wellbore. An annulus is thus formed between the string of casing and the formation. The casing string is temporarily hung from the surface of the well. The casing string is cemented into the wellbore by circulating cement into the annulus defined between the outer wall of the casing and the borehole. The combination of cement and casing strengthens the wellbore and facilitates the isolation of certain areas of the formation behind the casing for the production of hydrocarbons.

While drilling, it is advantageous to have a downhole sub, known as a circulation sub, that allows drilling fluid to be diverted on demand from the drill string bore to the annulus in order to facilitate operations, such as hole cleaning. Prior art circulation subs are operated by dropping a closure member, such as a ball or dart. These subs are problematic due to the time required for the closure member to reach the sub from surface and reliability issues encountered once the closure member reaches the sub.

SUMMARY OF THE INVENTION

Embodiments of the present invention generally relate to a telemetry operated circulation sub. In one embodiment, a circulation sub for use in a wellbore includes a tubular body having a bore therethrough, a port through a wall thereof, and a connector at each longitudinal end thereof. The circulation sub further includes a tubular mandrel longitudinally movable relative to the body between an open position and a closed position, the mandrel having a bore therethrough and a port through a wall thereof corresponding to the body port, the mandrel wall in alignment with the body port in the closed position and the ports being aligned in the open position. The circulation sub further includes a first biasing member operable to move the mandrel to the open position. The circulation sub further includes a sleeve longitudinally movable relative to the body between an open position and a closed position, a wall of the sleeve in alignment with the body port in the closed position and the sleeve wall being clear of the body port in the open position. The circulation sub further includes an actuator selectively operable to restrain the sleeve in the open and closed positions. The circulation sub further includes a piston operable to move the mandrel to the closed position and move the sleeve to the open position. The body port and a bore of the sleeve are in fluid communication when both the mandrel and the sleeve are in the open positions.

In another embodiment, a method of drilling a wellbore includes drilling the wellbore by injecting drilling fluid through a drill string extending into the wellbore from surface and rotating a drill bit of the drill string. The drill string further includes a circulation sub having a port closed during drilling. The drilling fluid exits the drill bit and carries cuttings from the drill bit. The drilling fluid and cuttings (returns) flow to the surface via an annulus formed between an outer surface of the tubular string and an inner surface of the wellbore. The method further includes after drilling at least a portion of the wellbore: halting drilling; sending a wireless instruction signal from the surface to a downhole portion of the drill string by articulating the drill string, acoustic signal, or mud pulse, thereby opening the port; and injecting drilling fluid through the drill string and into the annulus via the open port.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1A:
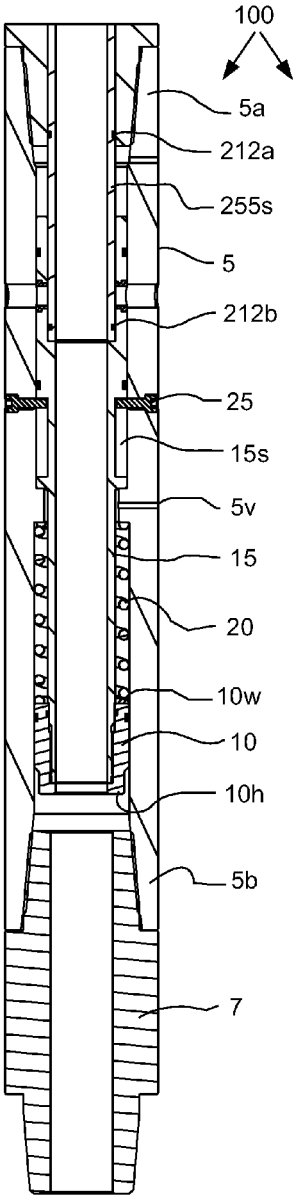
FIG. 1A is a cross section of a circulation sub in a closed position, according to one embodiment of the present invention.
Figure 1B:
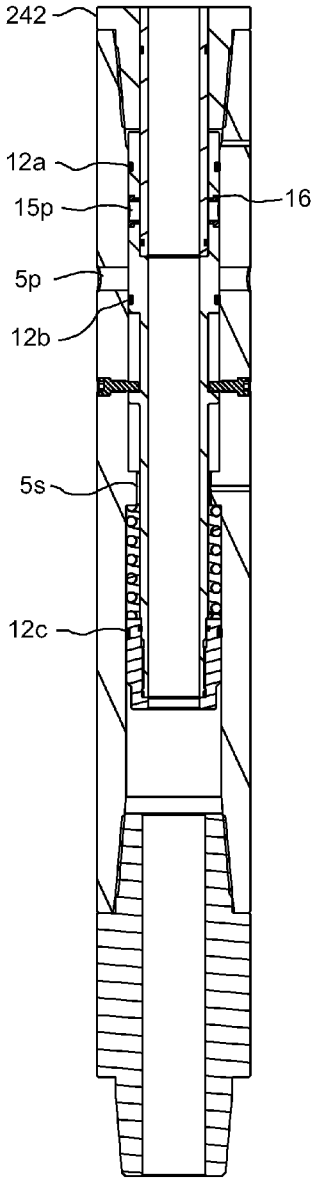
FIG. 1B is a cross section of the circulation sub in an intermediate position.
Figure 1C:
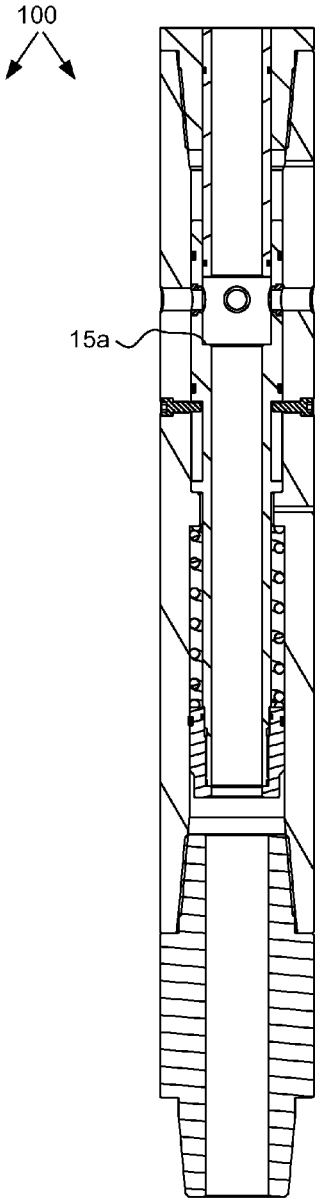
FIG. 1C is a cross section of the circulation sub in an open position.

FIG. 1A is a cross section of a circulation sub 100 in a closed position, according to one embodiment of the present invention. FIG. 1B is a cross section of the circulation sub 100 in an intermediate position. FIG. 1C is a cross section of the circulation sub 100 in an open position.

The circulation sub 100 may include a body 5, an adapter 7, a piston 10, a mandrel 15, a biasing member, such as spring 20, and one or more fasteners, such as anti-rotation screws 25. The body 5 may be tubular and have a longitudinal bore formed therethrough. Each longitudinal end 5*a,b* of the body 5 may be threaded for longitudinal and rotational connection to other members, such as a control module 200 at 5*a* and the adapter 7 at 5*b*. The body 5 may have one or more flow ports 5*p* formed through a wall thereof. The body 5 may also have a chamber formed therein at least partially defined by shoulder 5*s* for receiving the piston 10. An end of the adapter 7 distal from the body may also be threaded for longitudinal and rotational connection to another member of a bottomhole assembly (BHA).

The mandrel 15 may be a tubular, have a longitudinal bore formed therethrough, and may be disposed in the body bore. The mandrel 15 may have a flow port 15*p* formed through a wall thereof corresponding to each body port 5*p*. An insert 16 may be disposed in each port 15*p* and made from an erosion resistant material, such as a metal, alloy, ceramic, or cermet. The piston 10 may be annular, have a longitudinal bore formed therethrough, and be longitudinally connected to a lower end of the mandrel 15, such as by a threaded connection.

The circulation sub 100 may be fluid operated by drilling fluid injected through the drill string being at a higher pressure and drilling fluid and cuttings, collectively returns, flowing to surface via the annulus being at a lower pressure. A first surface 10*h* of the piston 10 may be isolated from a second surface 10*w* of the piston 10 by a seal 12*c* disposed between an outer surface of the piston 10 and an inner surface of the body 5. The higher pressure may act on the first surface 10*h* of the piston 10 via exposure to the mandrel bore and the lower pressure may act on the second surface 10*w* of the piston 10 via fluid communication with a vent 5*v* formed through the body wall, thereby creating a net actuation force and moving the mandrel 15 from the closed position to the intermediate position. Another pair of seals 12*a,b* may be disposed between the mandrel 15 and the body 5 and may straddle the ports 5*p*, 15*p*. Each of the seals 12*a-c* may be a ring or stack of seals, such as chevron seals, and made from a polymer, such as an elastomer. Alternatively, the seals 12*a-c* may be metallic piston rings. Various other seals, such as o-rings, may be disposed throughout the circulation sub 100.

The spring 20 may be disposed in the housing chamber between the piston 10 and the shoulder 5*s*, thereby longitudinally pushing the mandrel 15 and the piston away from the shoulder. The mandrel may 15 have one or more slots 15*s* formed in an outer surface thereof for each of the fasteners 25. Each fastener 25 may be disposed in a hole formed through a wall of the body 5 and have an end extending into each slot 15*s*, thereby rotationally connecting the mandrel 15 to the body 5 while allowing longitudinal movement of the mandrel relative to the body. Engagement of each fastener 25 with each end of the respective slot 15*s* may serve as longitudinal stops for movement of the mandrel 15 relative to the body 5.

Figures 2A, 2B, 2C:
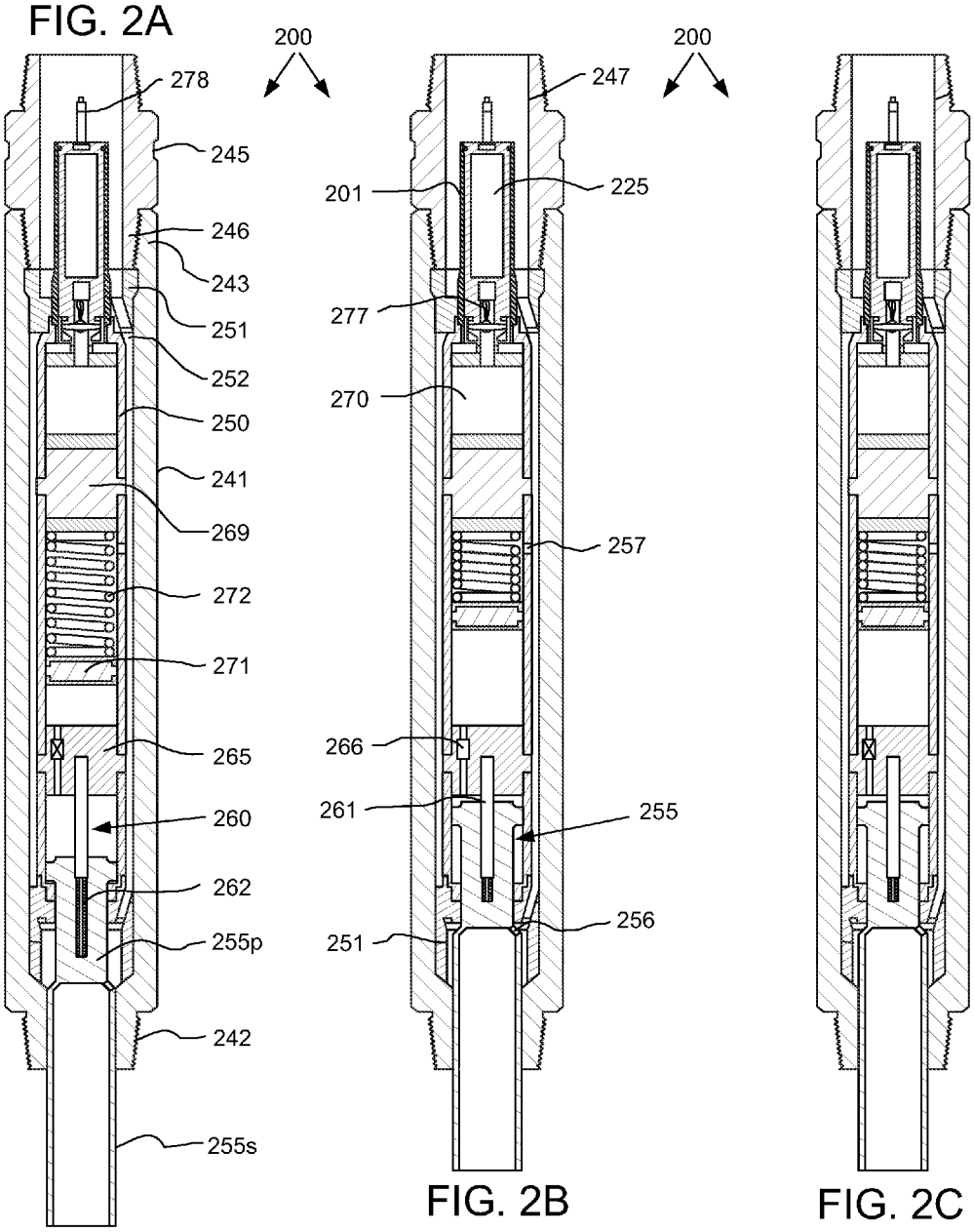
FIGS. 2A-2C are cross-sections of a control module for operating the circulation sub in the closed, intermediate, and open positions, respectively.

FIGS. 2A-2C are cross-sections of a control module 200 for operating the circulation sub 100 in the closed, intermediate, and open positions, respectively.

The control module 200 may include an outer tubular body 241. The lower end of the outer body 241 may include a threaded coupling, such as pin 242, connectable to the threaded end 5*a* of the circulation sub 100. The upper end of the outer body 241 may include a threaded coupling, such as box 243, connected to a threaded coupling, such as lower pin 246, of the retainer 245. The retainer 245 may have threaded couplings, such as pins 246 and 247, formed at its ends. The upper pin 247 may connect to a threaded coupling, such as box 408*b*, of a telemetry sub 400.

The outer body 241 may house an interior tubular body 250. The inner body 250 may be concentrically supported within the tubular body 241 at its ends by support rings 251. The support rings 251 may each be ported to allow drilling fluid flow to pass into/from a passage 252 formed between the two bodies 241, 250. The lower end of inner body 250 may slidingly support a follower 255. The follower 255 may include an upper piston portion 255*p* and a lower stinger portion 255*s* extending out of the outer body 241 for engagement with mandrel shoulder 15*a*. The follower 255 may be longitudinally moveable relative to the bodies 241, 250. The stinger portion 255*s* may cover the mandrel port 15*p* in the closed position and have a pair of seals 212*a,b* (FIGS. 1A-C) straddling the mandrel ports 15*p* and sealing against an inner surface of the mandrel 15. The seals 212*a,b* may be similar to the seals 12*a-c*. The stinger portion 255*s* may include one or more crossover ports 256 formed through a wall thereof for the flow of drilling fluid from the flow passage 252.

The interior of the piston 255 may be hollow in order to receive a longitudinal position sensor 260. The position sensor 260 may include two telescoping members 261 and 262. The lower member 262 may be connected to the piston 255 and be further adapted to travel within the first member 261. The amount of such travel may be electronically measured. The position sensor 260 may be a linear potentiometer. The upper member 261 may be attached to a lower bulkhead 265 which may be fixed within the inner body 250.

The lower bulkhead 265 may further include a shutoff valve 266 and passage extending therethrough. The shutoff valve 266 may include an electronic actuator, such as a solenoid (not shown). A conduit tube (not shown) may be attached at its lower end to the lower bulkhead 265 and at its upper end to and through an upper bulkhead 269 to provide electrical communication for the position sensor 260 and the solenoid valve 266 to a battery pack 270 located above the upper bulkhead 269. The battery pack 270 may include one or more batteries, such as high temperature lithium batteries. A compensating piston 271 may be slidingly positioned within the inner body 250 between the two bulkheads 265, 269. A biasing member, such as spring 272, may be located between the piston 271 and the upper bulkhead 269 and the chamber containing the spring may be vented 257 to allow the entry/exit of drilling fluid.

A tube 201 may be disposed in the connector sub 245 and may house an electronics package 225. The electronics package 225 may include a controller, such as a microprocessor, power regulator, and transceiver. Electrical connections 277 may be provided to interconnect the power regulator to the battery pack 270. A data connector 278 may be provided for data communication between the module controller and the telemetry sub 400. The data connector 278 may be wireless, such as a short-hop electromagnetic telemetry antenna.

Hydraulic fluid (not shown), such as oil, may be disposed in a lower chamber defined by the follower piston 255*p*, the lower bulkhead 265, and the inner body 250 and an upper chamber defined by the compensating piston 271, the lower bulkhead 265, and the inner body 250. The spring 272 may bias the compensating piston 271 to push hydraulic oil from the upper reservoir, through the bulkhead passage and valve 266, thereby extending the follower 255 into engagement with the circulation sub mandrel 15 and biasing the circulation sub 100 toward the closed position. The solenoid valve 266 may be operable between a closed position where the valve prevents flow between the lower chamber and the upper chamber (in either direction), thereby fluidly locking the circulation sub 100, and an open position where the valve allows flow through the passage (in either direction). To allow movement of the circulation sub 100, the valve 266 may be opened when drilling fluid is flowing. The circulation sub piston 10 may then actuate and push the follower 255 toward the lower bulkhead 265.

The position sensor 260 may measure the position of the follower 255. The module controller may monitor the sensor 260 to verify that the follower 255 has been actuated.

In operation, the control module 200 may receive a wireless instruction signal from surface (discussed below). The instruction signal may direct the control module 200 to allow movement of the circulation sub 100 to the intermediate position. The module controller may open the solenoid valve 266. If drilling fluid is being circulated through the BHA, the circulation sub piston 10 may then move the mandrel 15 and the follower 255 to the intermediate position. During movement to the intermediate position, the mandrel ports 15*p* may move out of alignment with the body ports 5*p* and the stinger 255*s* may move clear of the body ports 5*p*. During movement, the module controller may monitor the circulation sub 100 using the position sensor 260. Once the mandrel 15 has reached the intermediate position, the module controller may close the valve 266. The module controller may then report a successful move to the intermediate position or an error.

Flow of drilling fluid may then be halted. Pressure between the bore of the circulation sub 100 and the annulus may equalize and the circulation sub spring 20 may push the circulation sub piston 10 and the mandrel 15 to the open position. The follower 255 may be restrained from following the mandrel 15 by the closed valve 266 and the mandrel port 15*p* may re-align with the body port 5*p*, thereby opening the ports 5*p*, 15*p* and providing fluid communication between a bore of the drill string and the annulus formed between the drill string and the wellbore. Once the ports 5*p*, 15*p* are open, injection of drilling fluid may resume.

At least a portion of the drilling fluid may be diverted from flowing through the BHA by the open ports 5*p*, 15*p*, thereby facilitating a cleanout operation. Once the operation has concluded, a wireless instruction signal may be sent from surface to the control module 200 to close the circulation sub 100. The module controller may then open the valve 266. Injection of drilling fluid through the drill string may be halted and the control module spring 272 may push the stinger 255*s* back into engagement with the mandrel 15, thereby closing the ports 5*p*, 15*p*. The module controller may again monitor operation using the sensor 260, close the valve 266 once the closed position has been reached, and report successful closure to surface or an error message.

Alternatively, if the BHA is stuck, then flow through the BHA may be severely restricted or completely blocked. The control module and the circulation sub may still be operated by statically pressurizing the drill string and relieving the pressure from surface instead of pumping and halting flow of drilling fluid, as discussed above.

As shown, components of the control module 200 are disposed in a bore of the body 241 and connector 245. Alternatively, components of the control module 200 may be disposed in a wall of the body 241, similar to the telemetry sub 400. The center configured control module 200 may allow for: stronger outer collar connections, a single size usable for different size circulation subs, and easier change-out on the rig floor. The annular alternative arranged control module may provide a central bore therethrough so that tools, such as a wireline string, may be run-through through the drill string.

Additionally, a latch (not shown), such as a collet, may be formed in an outer surface of the follower 255. A corresponding profile may be formed in an inner surface of the interior body 250. The latch may engage the profile when the follower is in the closed position. The latch may transfer at least a substantial portion of the circulation sub piston 10 force to the interior body 250 when drilling fluid is injected through the circulation sub 100, thereby substantially reducing the amount of pressure required in the lower hydraulic chamber to restrain the circulation sub piston 10. Alternatively, the spring 272 may be disposed in the lower hydraulic chamber between the bulkhead 265 and the follower 255.

Figures 3A, 3B, 3C:
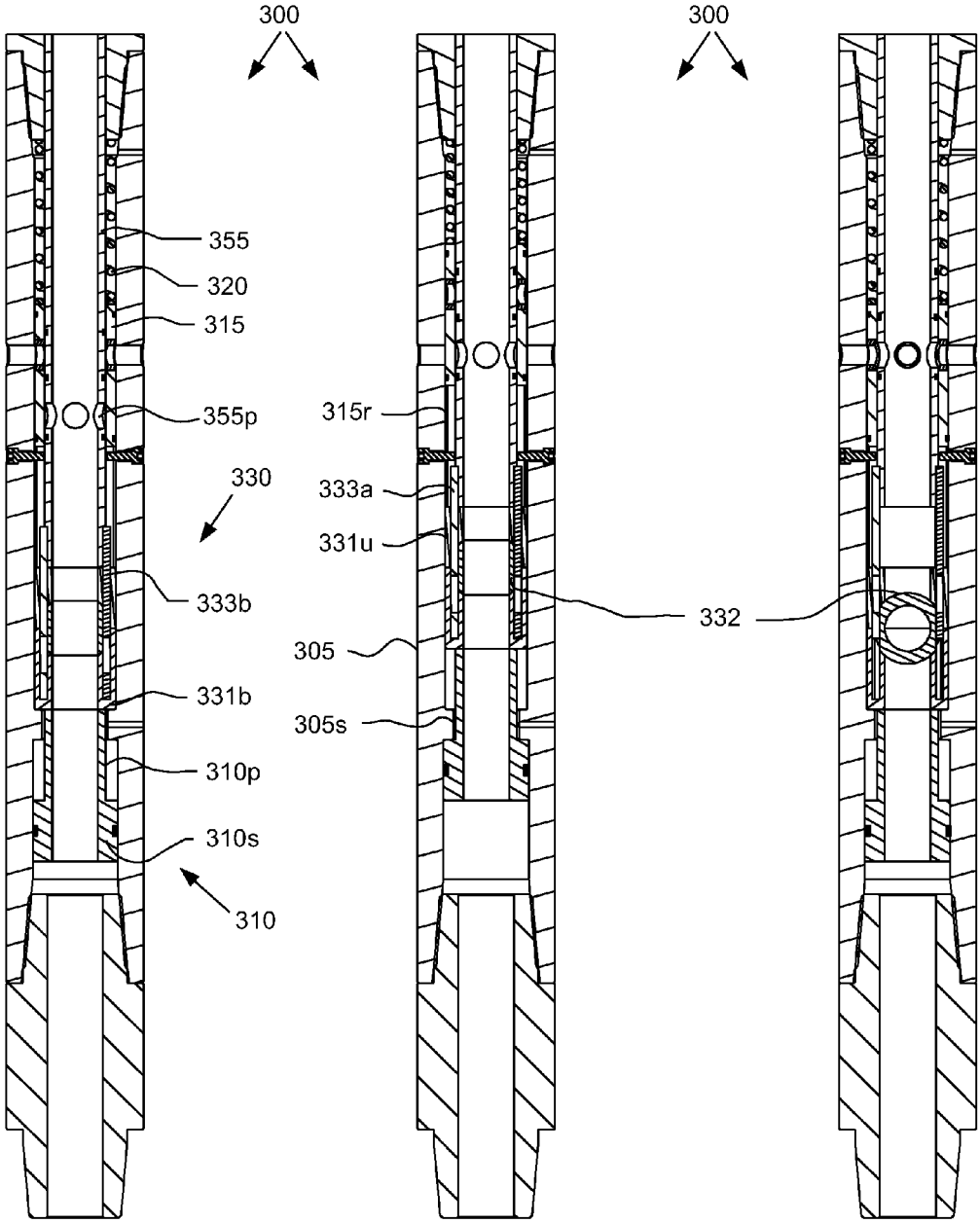
FIGS. 3A-3C are cross sections of a circulation sub in the closed, intermediate, and open positions, respectively, according to another embodiment of the present invention.

FIGS. 3A-3C are cross sections of a circulation sub 300 in the closed, intermediate, and open positions, respectively, according to another embodiment of the present invention.

The circulation sub 300 may operate in a similar fashion as the circulation sub 100 except that the circulation sub 300 may include a bore valve 330 and may be operated by a control module having a modified stinger 355 having a port 355*p* for each of the body/mandrel ports. The bore valve 330 may be operable between an open and a closed position. In the open position, the bore valve 330 may allow flow through the circulation sub 300 to the BHA. In the closed position, the bore valve 330 may seal the circulation sub bore below the body/mandrel/stinger ports, thereby preventing flow to the BHA and diverting all flow through the ports. The bore valve 330 may be operably coupled to the mandrel 315 and the stinger 355 such that the bore valve is open when the circulation sub 300 is in the closed and intermediate positions and the bore valve is closed when the circulation sub is in the open position.

The bore valve 330 may include a housing, such as a cage 331*u,b*, one or more seats (not separately shown), a valve member, such as a ball 332, and an actuator, such as a cam 333*a,b*. The cage 331*u,b* may include one or more sections, such as an upper section 331*u* and a lower 331*b* section. The cage 331*u,b* may be disposed within the housing 305 and connected thereto, such as by entrapment between the housing shoulder 305*s* and a lower recessed portion 315*r* of the mandrel 315. Each seat may include a seal and a retainer. Each seat retainer may be connected to a respective cage section. Each seat seal may be made from a polymer, such as an elastomer, and may be connected to the respective cage section by the respective seat retainer. The ball 332 may be disposed between the cage sections 331*u,b* and may be rotatable relative thereto. The ball 332 may be operable between an open position (FIGS. 3A and 3B) and a closed position (FIG. 3C) by cam 333*a,b*. The ball 332 may have a bore therethrough corresponding to the piston/sleeve bore and aligned therewith in the open position. A wall of the ball 332 may isolate the piston bore from the sleeve bore in the closed position.

To facilitate assembly, the cam 333*a,b* may include two or more sections, such as a left half 333*a* and a right half 333*b*. A lower portion of the cam 333*a,b* may be disposed in a pocket formed in the lower cage section 331*b* and an upper portion of the cam may be longitudinally and rotationally connected (not shown) to the stringer 355, such as by a locking profile or fasteners. The cam 333*a,b* may interact with the ball 332, such as by having a cam profile 334 (only partially shown), such as a slot, formed through a wall of each cam half and extending therealong. The ball 332 may have corresponding followers (not shown) formed in an outer surface thereof and engaged with respective cam profiles or vice versa. The ball-cam interaction may rotate the ball 332 between the open and closed positions in response to longitudinal movement of the ball 332 relative to the cam 333*a,b*.

The piston 310 may be separate from the mandrel 315 and have an upper pusher 310*p* portion and a lower shoulder 310*s* portion. When moving to the intermediate position, the pusher portion 310*p* may drive the bore valve 330, the mandrel 315, and the stinger 355 longitudinally upward relative to the body 305. When moving to the open position, the spring 320 may drive the mandrel 315, the cage 331*a,b*, the ball 332, and the piston 310 longitudinally downward relative to the housing 305, the stinger 355, and the cam 333*a,b*, thereby causing the ball to be rotated to the closed position.

Figure 4:
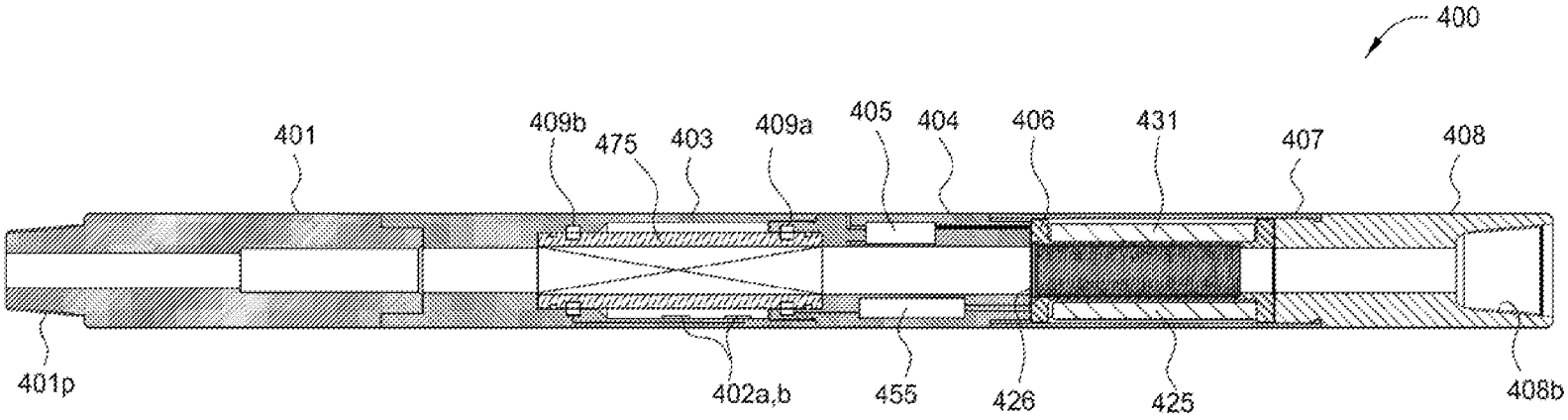
FIG. 4 illustrates a telemetry sub for use with the control module, according to another embodiment of the present invention.

FIG. 4 illustrates a telemetry sub 400 for use with the control module 200, according to another embodiment of the present invention. The telemetry sub 400 may include an upper adapter 401, one or more auxiliary sensors 402*a,b*, an uplink housing 403, a sensor housing 404, a pressure sensor 405, a downlink mandrel 406, a downlink housing 407, a lower adapter 408, one or more data/power couplings 409*a,b*, an electronics package 425, an antenna 426, a battery 431, accelerometers 455, and a mud pulser 475. The housings 403, 404, 407 may each be modular so that any of the housings 403, 404, 407 may be omitted and the rest of the housings may be used together without modification thereof. Alternatively, any of the sensors or electronics of the telemetry sub 400 may be incorporated into the control module 200 and the telemetry sub 400 may be omitted.

The adapters 401,408 may each be tubular and have a threaded coupling 401*p*, 408*b* formed at a longitudinal end thereof for connection with the control module 200 and another member of the drill string. Each housing may be longitudinally and rotationally connected together by one or more fasteners, such as screws (not shown), and sealed by one or more seals, such as o-rings (not shown).

The sensor housing 404 may include the pressure sensor 405 and a tachometer 455. The pressure sensor 405 may be in fluid communication with a bore of the sensor housing via a first port and in fluid communication with the annulus via a second port. Additionally, the pressure sensor 405 may also measure temperature of the drilling fluid and/or returns. The sensors 405,455 may be in data communication with the electronics package 425 by engagement of contacts disposed at a top of the mandrel 406 with corresponding contacts disposed at a bottom of the sensor housing 406. The sensors 405,455 may also receive electricity via the contacts. The sensor housing 404 may also relay data between the mud pulser 475, the auxiliary sensors 402*a,b*, and the electronics package 425 via leads and radial contacts 409*a,b*.

The auxiliary sensors 402*a,b* may include magnetometers which may be used with the accelerometers for determining directional information, such as azimuth, inclination, and/or tool face/bent sub angle. The auxiliary sensors 402*a,b* may also include strain gages oriented to measure longitudinal load and/or torque such that if the BHA is stuck, exerting tension and/or torque on the drill string may be used to send the instruction signal from surface to the telemetry sub. The tension and/or torque may be exerted according to a predetermined protocol. The modulated articulation may be detected by the auxiliary sensors. The controller 430 may then demodulate the signal and relay the signal to the module controller, thereby operating the circulation sub 100. The protocol may represent data by varying the articulation on to off, a lower tension/torque to a higher tension/torque and/or a higher tension/torque to a lower tension/torque, or monotonically increasing from a lower tension/torque to a higher tension/torque and/or a higher tension/torque to a lower tension/torque.

The antenna 426 may include an inner liner, a coil, and an outer sleeve disposed along an inner surface of the downlink mandrel 406. The liner may be made from a non-magnetic and non-conductive material, such as a polymer or composite, have a bore formed longitudinally therethrough, and have a helical groove formed in an outer surface thereof. The coil may be wound in the helical groove and made from an electrically conductive material, such as a metal or alloy. The outer sleeve may be made from the non-magnetic and non-conductive material and may be insulate the coil from the downlink mandrel 406. The antenna 426 may be longitudinally and rotationally coupled to the downlink mandrel 406 and sealed from a bore of the telemetry sub 400.

Figure 4A:
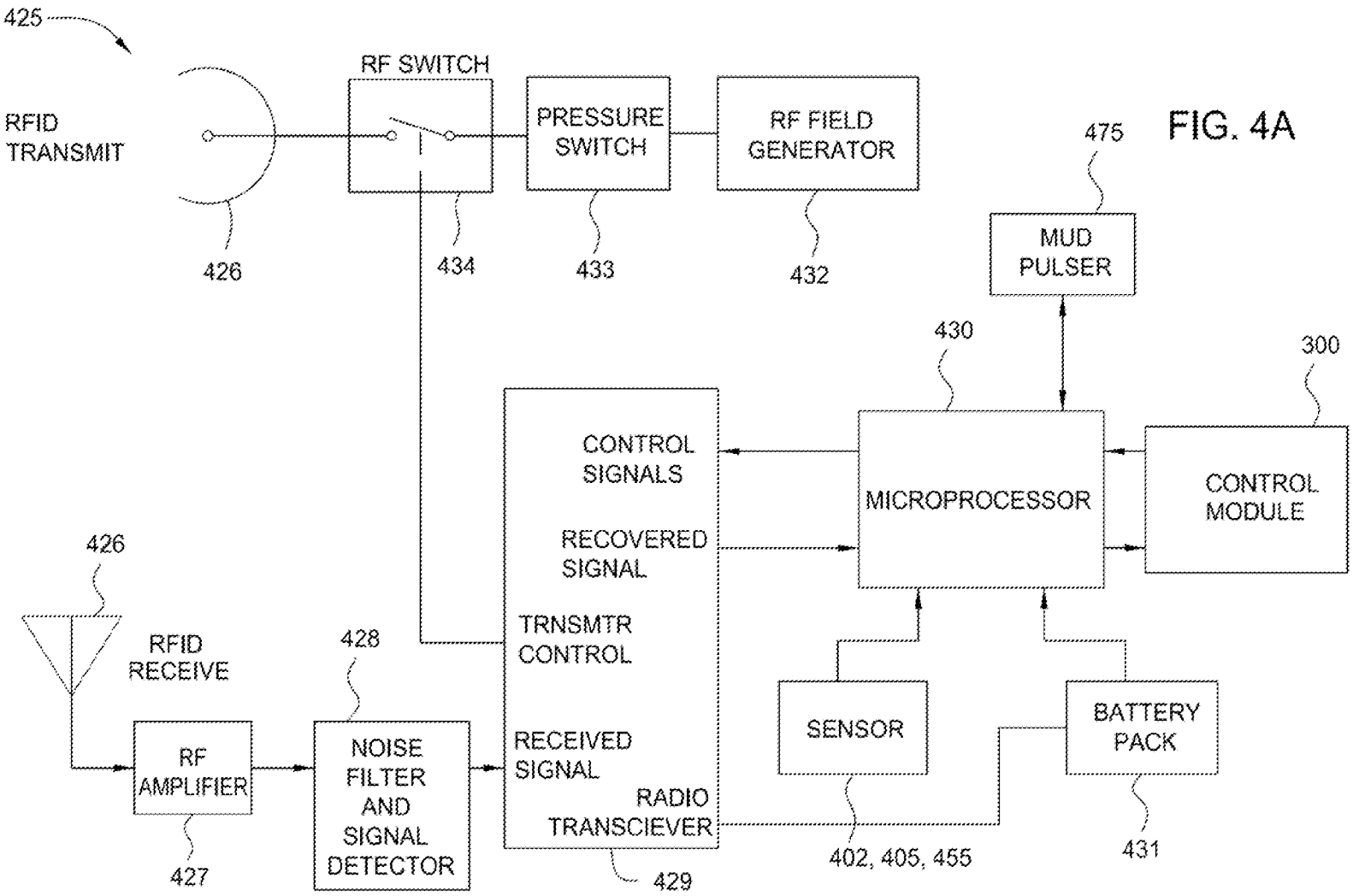
FIG. 4A illustrates an electronics package of the telemetry sub.
Figure 4B:
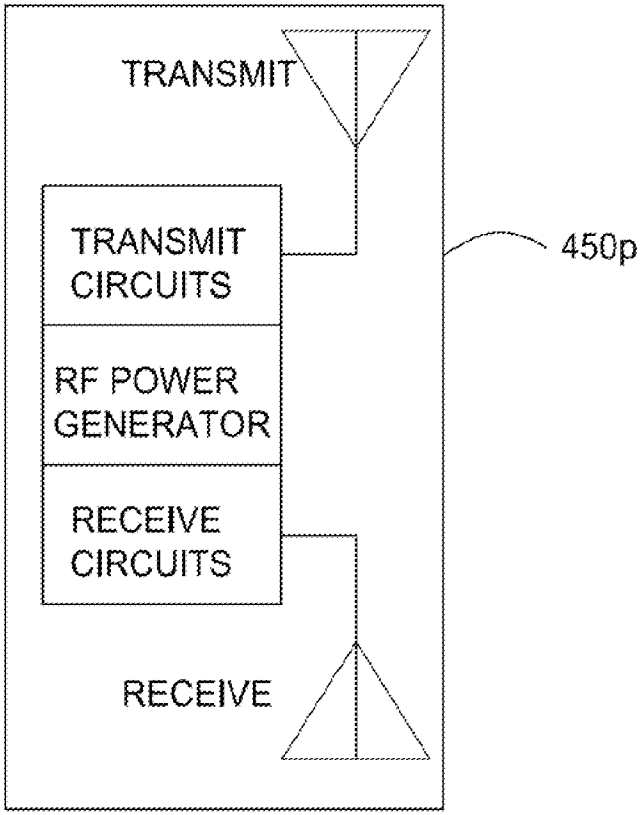
FIG. 4B illustrates an active RFID tag and a passive RFID tag for use with the telemetry sub.
Figure 4B:
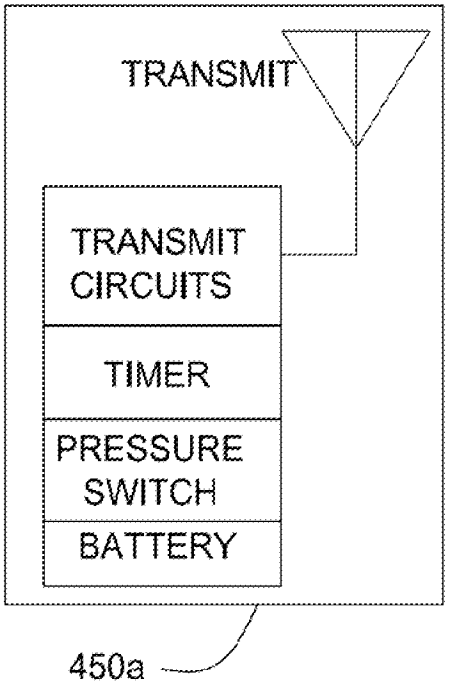

FIG. 4A illustrates the electronics package 425. FIG. 4B illustrates an active RFID tag 450*a* and a passive RFID tag 450*p*. The electronics package 425 may communicate with a passive RFID tag 450*p* or an active RFID tag 450*a*. Either of the RFID tags 450*a,p* may be individually encased and dropped or pumped through the drill string. The electronics package 425 may be in electrical communication with the antenna 426 and receive electricity from the battery 431. Alternatively, the data sub 400 may include a separate transmitting antenna and a separate receiving antenna. The electronics package 425 may include an amplifier 427, a filter and detector 428, a transceiver 429, a microprocessor 430, an RF switch 434, a pressure switch 433, and an RF field generator 432.

The pressure switch 433 may remain open at the surface to prevent the electronics package 425 from becoming an ignition source. Once the data sub 400 is deployed to a sufficient depth in the wellbore, the pressure switch 433 may close. The microprocessor 430 may also detect deployment in the wellbore using pressure sensor 405. The microprocessor 430 may delay activation of the transmitter for a predetermined period of time to conserve the battery 431.

When it is desired to operate the circulation sub 100, one of the tags 450*a,p* may be pumped or dropped from the surface to the antenna 426. If a passive tag 450*p* is deployed, the microprocessor 430 may begin transmitting a signal and monitoring for a response. Once the tag 450*p* is deployed into proximity of the antenna 426, the passive tag 450*p* may receive the signal, convert the signal to electricity, and transmit a response signal. The antenna 426 may receive the response signal and the electronics package 425 may amplify, filter, demodulate, and analyze the signal. If the signal matches a predetermined instruction signal, then the microprocessor 430 may communicate the instruction signal to the circulation sub control module 200 using the antenna 426 and the transmitter circuit. The instruction signal carried by the tag 450*a,p* may include an address of a tool (if the drill string includes multiple circulation subs) and a position command.

If an active tag 450*a* is used, then the tag 450*a* may include its own battery, pressure switch, and timer so that the tag 450*a* may perform the function of the components 432-434. Further, either of the tags 450*a,p* may include a memory unit (not shown) so that the microprocessor 430 may send a signal to the tag and the tag may record the signal. The signal may then be read at surface. The signal may be confirmation that a previous action was carried out or a measurement by one of the sensors. The data written to the RFID tag may include a date/time stamp, a set position (the command), a measured position (of control module position piston), and a tool address. The written RFID tag may be circulated to the surface via the annulus.

Alternatively, the control module 200 may be hard-wired to the telemetry sub 400 and a single controller, such as a microprocessor, disposed in either sub may control both subs. The control module 200 may be hard-wired by replacing the data connector 378 with contact rings disposed at or near the pin 347 and adding corresponding contact rings to/near the box 408*b* of the telemetry sub 400. Alternatively, inductive couplings may be used instead of the contact rings. Alternatively, a wet or dry pin and socket connection may be used instead of the contact rings.

Figure 4D:
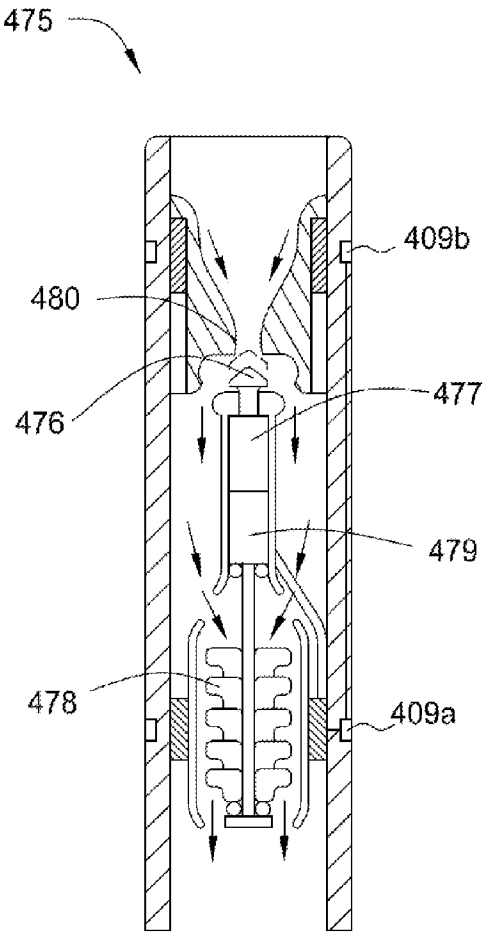
FIG. 4D illustrates a mud pulser of the telemetry sub.
Figure 4C:
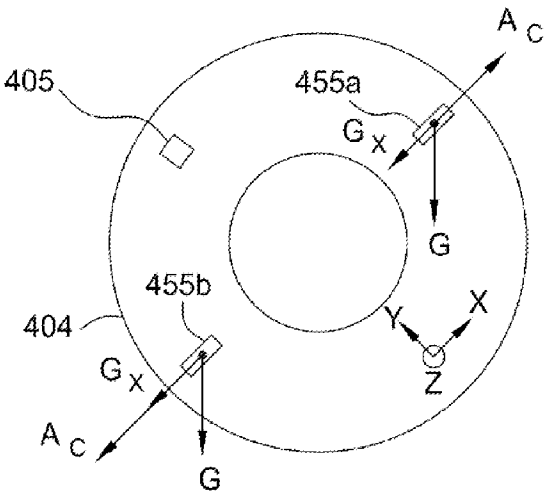
FIG. 4C illustrates accelerometers of the telemetry sub.

FIG. 4C is a schematic cross-sectional view of the sensor sub 404. The tachometer 455 may include two diametrically opposed single axis accelerometers 455*a,b*. The accelerometers 455*a,b* may be piezoelectric, magnetostrictive, servo-controlled, reverse pendular, or microelectromechanical (MEMS). The accelerometers 455*a,b* may be radially X oriented to measure the centrifugal acceleration $A_c$ due to rotation of the telemetry sub 400 for determining the angular speed. The second accelerometer may be used to account for gravity G if the telemetry sub is used in a deviated or horizontal wellbore. The angular speed may then be calculated from the accelerometer measurements. Alternatively, as the accelerometers may be tangentially Y oriented, dual axis, and/or asymmetrically arranged (not diametric and/or each accelerometer at a different radial location). Further, the accelerometers may be used to calculate borehole inclination and gravity tool face. Further, the sensor sub may include a longitudinal Z accelerometer. Alternatively, magnetometers may be used instead of accelerometers to determine the angular speed.

Instead of using one of the RFID tags 450*a,p* to activate the circulation sub 100, an instruction signal may be sent to the controller 430 by modulating angular speed of the drill string according to a predetermined protocol. The modulated angular speed may be detected by the tachometer 455. The controller 430 may then demodulate the signal and relay the signal to the module controller, thereby operating the circulation sub 100. The protocol may represent data by varying the angular speed on to off, a lower speed to a higher speed and/or a higher speed to a lower speed, or monotonically increasing from a lower speed to a higher speed and/or a higher speed to a lower speed.

Additionally or alternatively, the sensor sub may include an acoustic receiver and an instruction signal may be sent to the controller 430 by modulating an acoustic transmitter located at the surface. The acoustic transmitter may be operable to transmit an acoustic signal from the surface through a wall of the deployment string according to a predetermined protocol. The modulated acoustic signal may be detected by the acoustic receiver. The controller 430 may then demodulate the signal and relay the signal to the module controller, thereby operating the circulation sub 100. The protocol may represent data by varying the acoustic signal on to off, a lower frequency to a higher frequency and/or a higher frequency to a lower frequency, or monotonically increasing from a lower frequency to a higher frequency and/or a higher frequency to a lower frequency.

FIG. 4D illustrates the mud pulser 475. The mud pulser 475 may include a valve, such as a poppet 476, an actuator 477, a turbine 478, a generator 479, and a seat 480. The poppet 476 may be longitudinally movable by the actuator 477 relative to the seat 480 between an open position (shown) and a choked position (dashed) for selectively restricting flow through the pulser 475, thereby creating pressure pulses in drilling fluid pumped through the mud pulser. The mud pulses may be detected at the surface, thereby communicating data from the microprocessor to the surface. The turbine 478 may harness fluid energy from the drilling fluid pumped therethrough and rotate the generator 479, thereby producing electricity to power the mud pulser. The mud pulser may be used to send confirmation of receipt of commands and report successful execution of commands or errors to the surface. The confirmation may be sent during circulation of drilling fluid. Alternatively, a negative or sinusoidal mud pulser may be used instead of the positive mud pulser 475. The microprocessor may also use the turbine 478 and/or pressure sensor as a flow switch and/or flow meter.

Instead of using one of the RFID tags 450*a,p* or angular speed modulation to activate the circulation sub 100, a signal may be sent to the controller by modulating a flow rate of the rig drilling fluid pump according to a predetermined protocol. The telemetry sub controller may use the turbine and/or pressure sensor as a flow switch and/or flow meter to detect the sequencing of the rig pumps. The flow rate protocol may represent data by varying the flow rate on to off, a lower speed to a higher speed and/or a higher speed to a lower speed, or monotonically increasing from a lower speed to a higher speed and/or a higher speed to a lower speed. Alternatively, an orifice flow switch or meter may be used to receive flow rate signals communicated through the drilling fluid from the surface instead of the turbine and/or pressure sensor. Alternatively, the sensor sub may detect the flow rate signals using the pressure sensor and accelerometers to monitor for BHA vibration caused by the flow rate signal.

Alternatively, a mud pulser (not shown) may be installed in the rig pump outlet and operated by the surface controller to send pressure pulses from the surface to the telemetry sub controller 430 according to a predetermined protocol. The mud pulser alternative may be especially useful if the BHA is blocked or the bore valve 330 is closed. The pressure sensor 405 may be used to detect the mud pulses and the telemetry sub controller 430 may then decode the mud pulses and relay the signal to the control sub.

Alternatively, an electromagnetic (EM) gap sub (not shown) may be used instead of the mud pulser, thereby allowing data to be transmitted to the surface using EM waves. Alternatively, an RFID tag launcher (not shown) may be used instead of the mud pulser. The tag launcher may include one or more RFID tags. The microprocessor 430 may then encode the tags with data and the launcher may release the tags to the surface. Alternatively, an acoustic transmitter may be used instead of the mud pulser and the acoustic transmitter may be operable to transmit an acoustic signal through a wall of the deployment string. Alternatively, and as discussed above, instead of the mud pulser, RFID tags may be periodically pumped through the telemetry sub and the microprocessor may send the data to the tag. The tag may then return to the surface via an annulus formed between the workstring and the wellbore. The data from the tag may then be retrieved at the surface. Alternatively, and as discussed above, instruction signals may be sent to the electronics package using mud pulses, EM waves, or acoustic signals. Alternatively, the telemetry sub antenna may be toroidal and communication with surface may be via transverse electromagnetic signals (TEM) along the annulus, as shown in U.S. Pat. No. 4,839,644, which is herein incorporated by reference in its entirety.

For deeper wells, the drill string may further include a signal repeater (not shown) to prevent attenuation of the transmitted mud pulse, acoustic, or EM/TEM signals. The repeater may detect the mud pulse transmitted from the mud pulser 475 and include its own mud pulser for repeating the signal. As many repeaters may be disposed along the drill string as necessary to transmit the data to the surface, e.g., one repeater every five thousand feet. Each repeater may also be a telemetry sub and add its own measured data to the retransmitted data signal. If the mud pulser is being used, the repeater may wait until the data sub is finished transmitting before retransmitting the signal. The repeaters may be used for any of the mud pulser alternatives, discussed above. Repeating the transmission may increase bandwidth for the particular data transmission.

Alternatively, multiple telemetry subs may be deployed in the drill string. An RFID tag including a memory unit may be dropped/pumped through the telemetry subs and record the data from the telemetry subs until the tag reaches a bottom of the data subs. The tag may then transmit the data from the upper subs to the bottom sub and then the bottom sub may transmit all of the data to the surface.

Alternatively, the mud pulser may instead be located in a measurement while drilling (MWD) and/or logging while drilling (LWD) tool assembled in the drill string downstream of the circulation sub. The MWD/LWD module may be located in the BHA to receive written RFID tags from several upstream tools. The mud pulse module or MWD/LWD module may then pulse a signal to the surface indicating time to shut down pumps to allow passive activation. Alternatively, the mud pulse module or MWD/LWD module may send a mud-pulse to annulus pressure measurement module (PWD subs) along the drill string. The PWD module may then upon command, or periodically, write RFID tags and eject the tags into the annulus for telemetry to surface or into the bore for telemetry to the MWD/LWD module.

Alternatively, the control module may send and receive instructions via wired drill/casing string.

Figure 5:
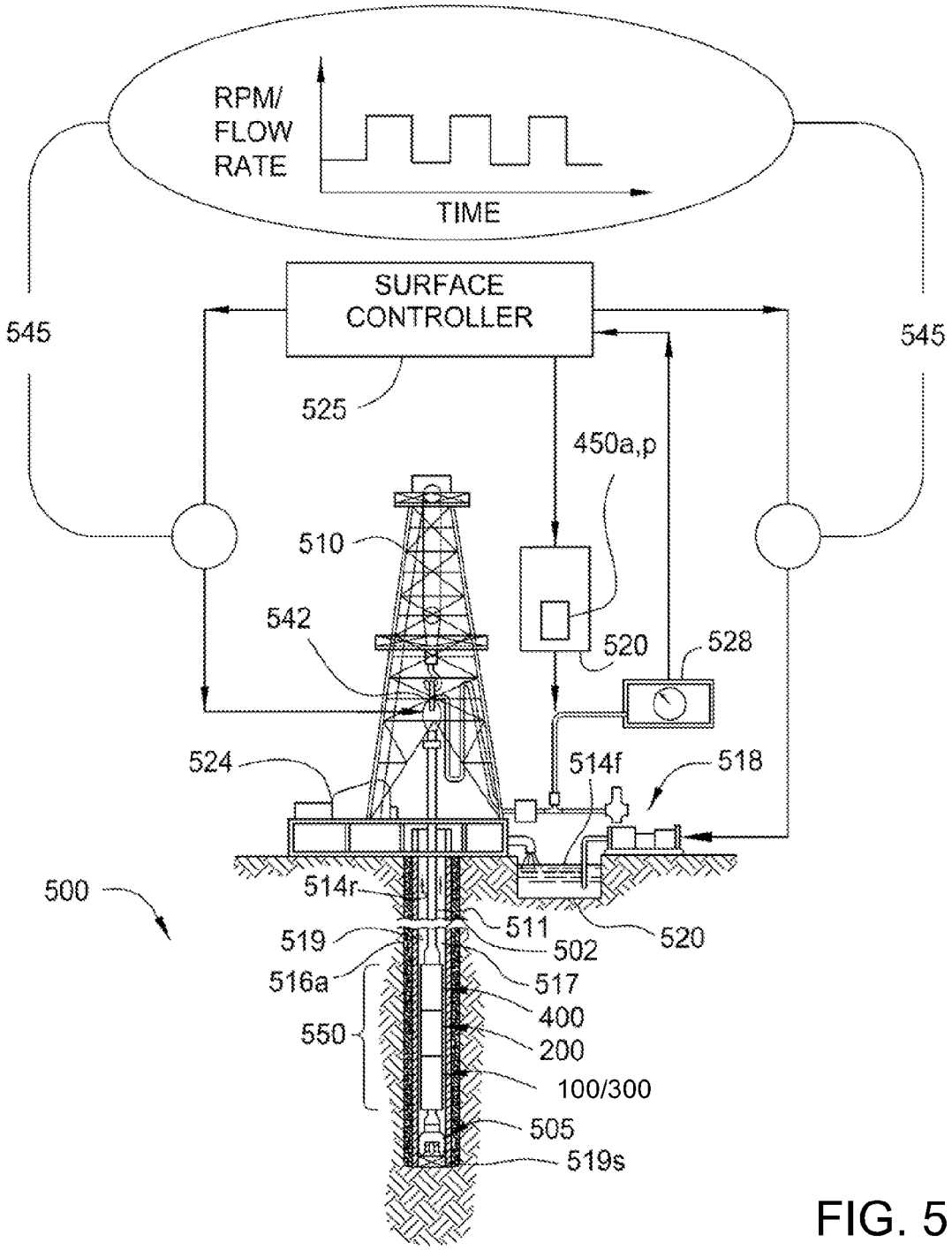
FIG. 5 illustrates a drilling system and method utilizing the circulation sub, according to another embodiment of the present invention.

FIG. 5 illustrates a drilling system and method utilizing the circulation sub 100/300, according to another embodiment of the present invention.

The drilling system may include a drilling derrick 510. The drilling system may further include drawworks 524 for supporting a top drive 542. The top drive 542 may in turn support and rotate a drill string 500. Alternatively, a Kelly and rotary table (not shown) may be used to rotate the drill string instead of the top drive. The drill string 500 may include a deployment string 502 and a bottomhole assembly (BHA) 550. The deployment string 502 may include joints of threaded drill pipe connected together or coiled tubing. The BHA 550 may include the telemetry sub 400, the control module 200, the circulation sub 100/300, and a drill bit 505. A rig pump 518 may pump drilling fluid, such as mud 514*f*, out of a pit 520, passing the mud through a stand pipe and Kelly hose to a top drive 542. The mud 514*f* may continue into the drill string, through a bore of the drill string, through a bore of the BHA, and exit the drill bit 505. The mud 514*f* may lubricate the bit and carry cuttings from the bit. The drilling fluid and cuttings, collectively returns 514*r*, flow upward along an annulus 517 formed between the drill string and the wall of the wellbore 516*a*/casing 519, through a solids treatment system (not shown) where the cuttings are separated. The treated drilling fluid may then be discharged to the mud pit for recirculation.

The drilling system may further include a launcher 520, surface controller 525, and a pressure sensor 528. The pressure sensor 528 may detect mud pulses sent from the telemetry sub 400. The surface controller 525 may be in data communication with the rig pump 518, launcher 520, pressure sensor 528, and top drive 542. The rig pump 518 and/or top drive 542 may include a variable speed drive so that the surface controller 525 may modulate 545 a flow rate of the rig pump 518 and/or an angular speed (RPM) of the top drive 542. The modulation 545 may be a square wave, trapezoidal wave, or sinusoidal wave. Alternatively, the controller 545 may modulate the rig pump and/or top drive by simply switching them on and off.

A first section of a wellbore 516*a* has been drilled. A casing string 519 has been installed in the wellbore 516*a* and cemented 511 in place. A casing shoe 519*s* remains in the wellbore. The drill string 500 may then be deployed into the wellbore 516*a* until the drill bit 505 is proximate the casing shoe 519*s*. The drill bit 505 may then be rotated by the top drive and mud injected through the drill string by the rig pump. Weight may be exerted on the drill bit 505, thereby causing the drill bit to drill through the casing shoe 519*s*. The circulation sub 100/300 may be restrained in the closed position by the control module 200. Once the casing shoe 519*s* has been drilled through, a second section of the wellbore may be drilled. Alternatively, instead of drilling through the casing shoe, a sidetrack may be drilled or the casing shoe may have been drilled during a previous trip.

Once drilling of the second section is complete, it may be desirable to perform a cleaning operation to clear the wellbore 516*r* of cuttings in preparation for cementing a second string of casing. An instruction signal may be sent to the telemetry sub 400 commanding actuation of the circulation sub 100/300 to the intermediate position. The telemetry sub 400 may relay the signal to the control module 200. The circulation sub 100/300 may then move to the intermediate position, as discussed above. The control module may confirm successful movement to the intermediate position. The rig pump 518 may then be shut down, thereby allowing the circulation sub to open. The rig pump 518 may resume circulation of drilling fluid. The cleaning operation may involve rotation of the drill string 500 at a high angular velocity. The drill string 500 may be removed from the wellbore 516*a* during the cleaning operation. Alternatively or additionally, the cleaning operation may be occasionally or periodically performed during the drilling operation.

Alternatively, the drill bit may be rotated at a high speed by a mud motor (not shown) of the BHA and the circulation sub may be rotated at a lower speed by the top drive. Since the bit speed may equal the motor speed plus the top drive speed, the mud motor speed may be equal or substantially equal to the top drive speed.

For directional drilling operations, the telemetry sub 400 may be used as an MWD sub for measuring and transmitting orientation data to the surface. Alternatively, the BHA may include a separate MWD sub. The surface may need to send instruction signals to the separate MWD sub in addition to the instruction signals to the telemetry sub. If modulation of the rig pump is the chosen communication media for both MWD and circulation sub instruction signals, then the protocol may include an address field or the signals may be multiplexed (e.g., frequency division). Alternatively, modulation of the rig pump may be used to send MWD instructions and top drive modulation may be used to send circulation sub instructions. If dynamic steering is employed and the circulation sub instruction signal is sent by top drive modulation, then the circulation sub signal may be multiplexed with the dynamic steering signal. Alternatively, the RFID tag protocol may include an address field distinguishing the instructions.

Alternatively, the circulation sub may be used in a drilling with casing/liner operation. The deployment string may include the casing/liner string instead of the drill string. The BHA may be operated by rotation of the casing/liner string from the surface of the wellbore or a motor as part of the BHA. After the casing/liner is drilled and set into the wellbore, the BHA may be retrieved from the wellbore. To facilitate retrieval of the BHA, the BHA may be fastened to the casing/liner string employing a latch. Alternatively, the BHA may be drillable. Once the BHA is retrieved, the casing/liner string may then be cemented into the wellbore.

Alternatively, the circulation sub may be used in an expandable casing/liner operation. The casing/liner may be expanded after it is run-into the wellbore.

Additionally, multiple circulation subs may be employed in the drill string at various locations along the drill string. The instruction signal may then include a tool address so that one or more of the circulation subs may be opened without opening one or more other subs. Alternatively, all of the subs may be opened simultaneously. Further one or more of the subs may be the sub 300 and one or more of the subs may be the sub 100.

Alternatively, the circulation sub 300 may be used to pump kill fluid through the drill string 502 to control a kick while preventing the kill fluid from being pumped through a lower portion of the BHA. Alternatively, the BHA may further include a disconnect sub should the BHA become stuck. The disconnect sub may be operated by a closure member or by an additional control module 200. The circulation subs 100, 300 allow flexibility to have a closure member operated tool disposed in the BHA above or below the circulation sub. The drill string may then be disconnected from the stuck BHA, the drill string (and upper portion of the disconnect) retrieved to surface, and redeployed with a fishing BHA including, for example, a jar (single fire or vibratory) and the upper portion of the disconnect, which also may be operated by a closure member or an additional control module 200.

Figure 6:
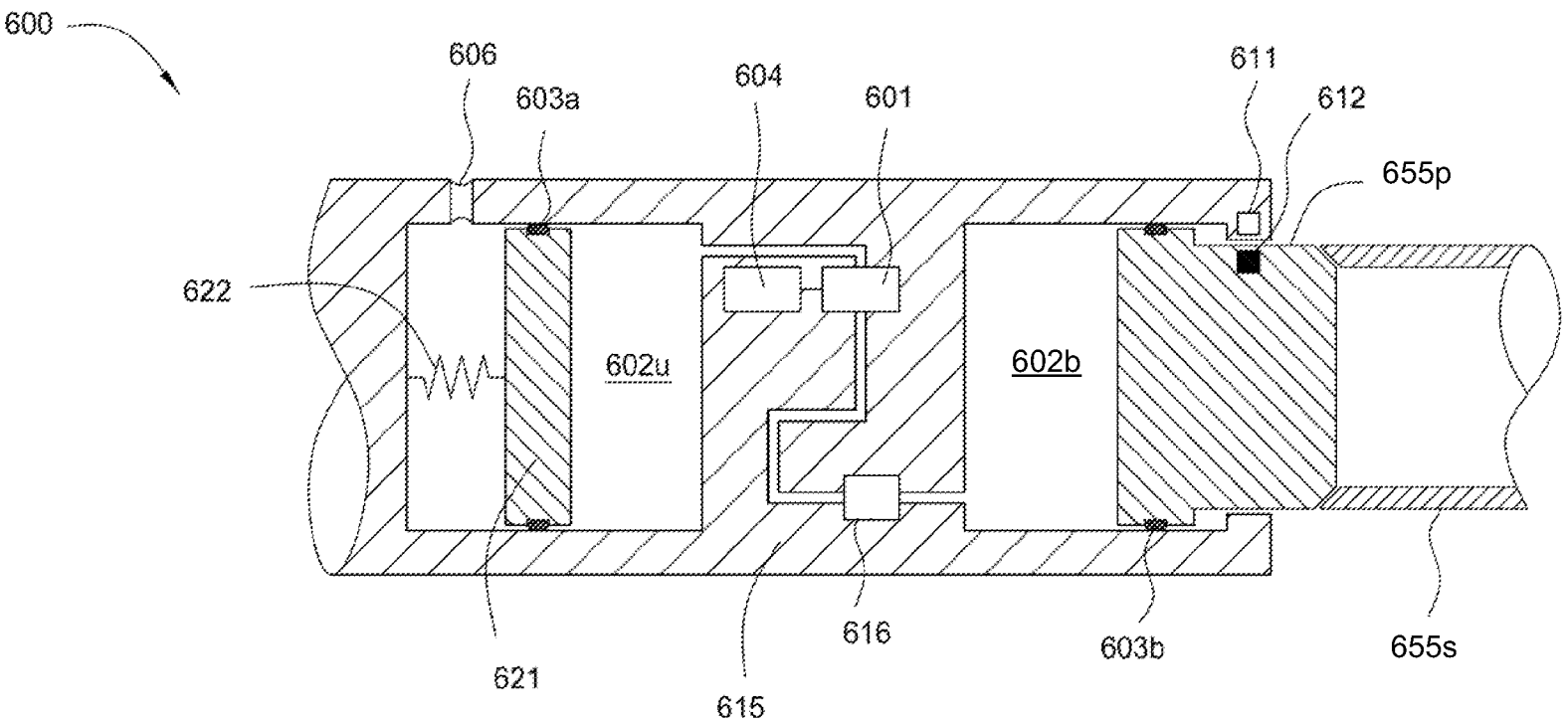
FIG. 6 illustrates a control module for use with the circulation sub, according to another embodiment of the present invention.

FIG. 6 illustrates a portion of an alternative control module 600 for use with a simplified circulation sub (not shown), according to another embodiment of the present invention. Relative to the circulation sub 100, the mandrel, piston, and spring may be omitted from the simplified circulation sub and the stinger 655*s* may directly close and open the body ports. Additionally, the simplified circulation sub may include a simplified version of the bore valve 330. The rest of the control module 600 may be similar to the control module 200.

The control module 600 may include an inner body and bulkhead 615. For ease of depiction, the bulkhead and inner body are shown as an integral piece 615. To facilitate manufacture and assembly, the inner body and bulkhead may be made as separate pieces. The control module 600 may further include upper 602*u* and lower 602*b* hydraulic chambers having hydraulic fluid disposed therein and isolated by seals 603*a,b*. The control module 600 may further include an actuator so that the control module 600 may actively move the stinger 655*s* while the rig pump 518 is injecting drilling fluid through the control module 600 and the simplified circulation sub. The actuator may be a hydraulic pump 601 in communication with the upper 602*u* and lower 602*b* hydraulic chambers via a hydraulic passage and operable to pump the hydraulic fluid from the upper chamber 602*u* to the lower chamber 602*b* to move the stinger 655*s*. Alternatively, the pump may be a hydraulic amplifier on a lead or ball screw being turned by the electric motor.

The electric motor 604 may drive the hydraulic pump 601. The electric motor 604 may be reversible to cause the hydraulic pump 601 to pump fluid from the lower chamber 602*b* to the upper chamber 602*u*. The active control module 600 may receive an instruction signal from the surface (as discussed above via the telemetry sub 400) and operate the circulation sub without having to wait for shut down of the rig pump 518.

The control module 600 may further include a shutoff valve 616 having an electric actuator, such as a solenoid for locking the stinger in either the open or closed position. The control module 600 may further include a position sensor, such as a Hall sensor 611 and magnet 612, which may be monitored by the controller 325. Alternatively, the position sensor may be a linear voltage differential transformer (LVDT). The control module 600 may further include a compensating piston 621 to equalize pressure between drilling fluid (via port 606) and the upper chamber 602*u*. The control module may further include a biasing member, such as a spring 622, to bias flow of hydraulic fluid from the upper 602*u* to the lower 602*b* chamber.

While the foregoing is directed to embodiments of the present invention, other and further embodiments of the invention may be devised without departing from the basic scope thereof, and the scope thereof is determined by the claims that follow.

The invention claimed is:

1. A circulation sub for use in a wellbore, comprising:

a tubular body having a bore therethrough, a body port through a wall thereof, and a connector at each longitudinal end thereof;

a tubular mandrel longitudinally movable relative to the body between an open position and a closed position, the mandrel having a bore therethrough and a mandrel port through a mandrel wall thereof corresponding to the body port, the mandrel wall in alignment with the body port in the closed position and the mandrel port being aligned with the body port in the open position;

a sleeve longitudinally movable relative to the body between an open position and a closed position, a sleeve wall in alignment with the body port in the closed position;

an actuator comprising:

a first hydraulic chamber;

a second hydraulic chamber; and a valve selectively operable to lock the first hydraulic chamber to restrain the sleeve in the open and closed positions, wherein the first hydraulic chamber varies in response to movement of the sleeve, and the valve is operable to provide fluid communication between the hydraulic chambers in an open position and to fluidly isolate the chambers in a closed position;

a piston operable to:

move the mandrel to the closed position, and move the sleeve to the open position; and a first biasing member operable to move the mandrel to the open position;

wherein the body port and a bore of the sleeve are in fluid communication when both the mandrel and the sleeve are in the open positions.

2. The circulation sub of claim 1, wherein the piston is connected to the mandrel.

3. The circulation sub of claim 1, wherein:

a sleeve port is formed through the sleeve wall corresponding to the body port, and the body port and the sleeve port are aligned in the sleeve open position.

4. The circulation sub of claim 3, further comprising:

a bore valve operable between an open position and a closed position, wherein the bore valve is closed when both the mandrel and the sleeve are in the open positions, and the bore valve is open when the sleeve is in the closed position or when the mandrel is in the closed position.

5. The circulation sub of claim 4, further comprising:

a cam operable to open and close the bore valve in response to relative longitudinal movement between the cam and the bore valve, wherein the cam is connected to the sleeve, and the bore valve is coupled to the mandrel and the piston.

6. The circulation sub of claim 4, wherein:

the piston has a piston bore therethrough, the bore valve allows free passage through the sleeve bore and piston bore in the open position, and the bore valve isolates the piston bore from the sleeve bore in the closed position.

7. The circulation sub of claim 1, further comprising a second biasing member operable to move the sleeve to the closed position.

8. The circulation sub of claim 1, wherein the actuator comprises:

a sensor operable to detect articulation of the body, and a controller operable to release the sleeve in response to detecting the articulation according to a protocol.

9. The circulation sub of claim 1, wherein the actuator comprises:

a sensor operable to detect pressure in the sleeve bore, and a controller operable to release the sleeve in response to detecting pressure pulses according to a protocol.

10. The circulation sub of claim 1, wherein the actuator comprises:

a sensor operable to detect an acoustic signal transmitted through the body wall, and a controller operable to release the sleeve in response to detecting the acoustic signal according to a protocol.

11. The circulation sub of claim 1, wherein the mandrel acts on the sleeve to move the sleeve to the open position when the mandrel is moved by the piston to the closed position.

12. A method of drilling a wellbore, comprising:

drilling the wellbore by injecting drilling fluid through a drill string extending into the wellbore from surface and rotating a drill bit of the drill string, wherein the drill string further comprises a circulation sub, wherein the circulation sub comprises:

a tubular body having a bore and a body port;

a tubular mandrel longitudinally movable relative to a body between an open position and a closed position, the mandrel having a bore therethrough and a mandrel port, the mandrel wall in alignment with the body port in the closed position and the mandrel port being aligned with the body port in the open position; and a sleeve longitudinally movable relative to the body between an open position and a closed position, a sleeve wall in alignment with the body port in the closed position, wherein during drilling, the tubular mandrel is in the open position and the sleeve is in the closed position, the drilling fluid exits the drill bit and carries cuttings from the drill bit, and the drilling fluid and cuttings flow to the surface via an annulus formed between an outer surface of the tubular string and an inner surface of the wellbore; and after drilling at least a portion of the wellbore:

halting drilling;

sending a wireless instruction signal from the surface to a downhole portion of the drill string by articulating the drill string, acoustic signal, or mud pulse, thereby opening the body port, wherein opening the body port comprises:

simultaneously moving the mandrel to the closed position and the sleeve to the open position; and moving the mandrel to the open position; and injecting drilling fluid through the drill string and into the annulus via the open body port.

13. The method of claim 12, wherein simultaneously moving the mandrel to the closed position and the sleeve to the open position comprises:

moving the mandrel to the closed position using a piston while the mandrel acts on the sleeve to move the sleeve to the open position.

14. The method of claim 12, further comprising retaining the sleeve in the closed position during drilling using an actuator; and retaining the sleeve in the opening position when injecting drilling fluid through the drill string and into the annulus via the open body port, wherein the actuator comprises a fluid chamber and a valve selectively operable to lock the fluid chamber to restrain the sleeve in the open position and closed position.

15. A circulation sub for use in a wellbore, comprising:

a tubular body having a body bore therethrough and a body port through a body wall thereof;

a tubular mandrel longitudinally movable relative to the tubular body between an open position and a closed position, wherein the mandrel has a mandrel bore therethrough and a mandrel port through a mandrel wall thereof, the mandrel wall is in alignment with the body port in the closed position, and the mandrel port is aligned with the body port in the open position;

a sleeve longitudinally movable relative to the body between an open position and a closed position, wherein the sleeve has a sleeve bore therethrough, and a sleeve wall is in alignment with the body port in the closed position;

an actuator selectively operable to restrain the sleeve in the open and closed positions, wherein the actuator comprises:

a hydraulic chamber;

a valve selectively operable to lock the hydraulic chamber to retain the sleeve in the open position and the closed position; and a biasing member operable to move the sleeve to the closed position;

a piston operable to simultaneously move the mandrel to the closed position and the sleeve to the open position; and a spring operable to move the mandrel to the open position, wherein the body port and the sleeve bore are in fluid communication when both the mandrel and the sleeve are in the open positions.

16. The circulation sub of claim 15, wherein the mandrel acts on the sleeve to move the sleeve to the open position when the mandrel is moved by the piston to the closed position.

17. The circulation sub of claim 15, wherein a sleeve port is formed through the sleeve wall corresponding to the body port, and the body port and the sleeve port are aligned in the sleeve open position.

* * * * *